United States Patent [19]

Fujimoto et al.

[11] 4,061,328

[45] Dec. 6, 1977

[54] PAPER FEEDER

[75] Inventors: Sakae Fujimoto, Chofu; Takaji Sue, Kawasaki; Toshihiko Misawa, Tokyo, all of Japan

[73] Assignee: Ricoh Co., Ltd., Tokyo, Japan

[21] Appl. No.: 696,399

[22] Filed: June 15, 1976

[30] Foreign Application Priority Data

| | | |
|---|---|---|
| June 25, 1975 | Japan | 50-79648 |
| June 25, 1975 | Japan | 50-79647 |
| June 19, 1975 | Japan | 50-74773 |

[51] Int. Cl.[2] ..... B65H 3/44; B65H 3/46

[52] U.S. Cl. ..... 271/10; 271/9; 271/34; 271/118; 271/121; 271/127; 271/170

[58] Field of Search ..... 271/6, 7, 9, 10, 34, 271/117, 118, 121, 124, 126, 127, 162, 170

[56] References Cited

U.S. PATENT DOCUMENTS

| | | | |
|---|---|---|---|
| 3,219,339 | 11/1965 | Gutierrez | 271/34 X |
| 3,768,803 | 10/1973 | Stange | 271/34 |
| 3,857,558 | 12/1974 | Patel | 271/170 X |
| 3,874,652 | 4/1975 | Bilbrey | 271/124 X |
| 3,941,373 | 3/1976 | Stange | 271/34 X |
| 3,963,339 | 6/1976 | Taylor et al. | 271/9 X |

OTHER PUBLICATIONS

Caudill et al.; Sheet Paper Feed System; IBM Technical Disclosure Bulletin; vol. 14, No. 5; Oct. 1971; p. 1455.

*Primary Examiner*—Robert W. Saifer
*Attorney, Agent, or Firm*—Cooper, Dunham, Clark, Griffin & Moran

[57] ABSTRACT

A paper feeder is disclosed comprising a corner separator located on a paper tray on which a plurality of sheets are disposed in a stack and are fed one by one by means of a feed roller. The paper feeder is also provided with a second paper separator which operates, in the event of failure of paper separation by the corner separator to which results in a plurality of sheets being simultaneously fed from the paper tray, to separate the plurality of sheets into single sheets, thus assuring that the sheets are reliably fed into a sheet processing apparatus one by one. The second separator comprises an endless, sheet conveying belt which is disposed above a sheet passageway which connects the paper tray and the sheet processing apparatus, the belt cooperating with a frictional member which is disposed below the sheet passageway in opposing relationship with the sheet conveying belt.

10 Claims, 21 Drawing Figures

PAPER FEEDER

BACKGROUND OF THE INVENTION

The invention relates to a paper feeder for use in a copying machine or facsimile system, and more particularly to such a paper feeder having a sheet separator which separates and feeds sheets one by one from a stack disposed on a paper tray.

A variety of sheet separating members or apparatus are known for feeding the uppermost sheet from a sheet stack on a paper tray by means of a feed roller. By way of example, a corner separator may be disposed at each corner of the leading end of the tray. Alternatively, an apparatus may be used which is adapted to feed the sheets one by one through a clearance having a gap length corresponding to the thickness of a single sheet. As a further alternative, a pair of oppositely rotating rollers may be disposed in mating relationship so that when a plurality of sheets are simultaneously fed from the paper tray, the uppermost sheet is fed in a given direction by one of the rollers, while the forward movement of the remaining sheet or sheets is blocked by the other roller.

However, these known sheet separators operate alone. In other words, the conventional paper feeder is only provided with a single separator, so that no remedy can be applied whenever the one separator fails to provide its intended separating operation, resulting in the inconveniences that two or more sheets may be fed into a sheet processing apparatus such as a copying machine of facsimile transceiver or a jamming of sheets may occur on a sheet passage which connects the paper feeder with the sheet processing apparatus. Such failure of sheet separation can be usually avoided where sheets of a kind which are compatible with a particular sheet separator are normally used. However, a variety of sheets are used in copying machines or facsimile systems, and hence a perfect sheet separating action cannot be expected from a single sheet separator for all kinds of sheets. In particular, in the facsimile transceiver, various kinds of sheets are used as an original for transmission. When they are disposed in a stack on the paper tray in order to be separated sheet by sheet, it is hardly possible to assure against the failure of sheet separation.

SUMMARY OF THE INVENTION

According to the invention, a paper feeder comprises, in addition to a first sheet separator in the form of a corner separator which is usually provided on a paper tray, a second sheet separator which comprises a sheet conveying, endless belt and a frictional member. The second sheet separator operates, in the event of failure of perfect sheet separation by the first sheet separator, to provide a perfect sheet separation so that only a single sheet may be fed into the sheet processing apparatus at any time. To further assure the sheet separation, a third sheet separator may be located between the first and second sheet separators.

In a facsimile transceiver, the sheet used for reception is uniform in quality while the original for transmission includes a variety of sheets including very thin sheets and crumpled or creased sheets. Usually such an original sheet is held sandwiched in a sheet carrier which comprises a folded, transparent sheet member. Such sheet carriers are disposed in a stack on a paper tray, and it is usually possible to separate and feed them one by one through a satisfactory sheet separating action of the first sheet separator alone. However, the provision of the second sheet separator causes difficulties in this situation. In accordance with a further aspect of the invention, means is provided which disables the second sheet separator when such sheet carriers are used.

It is an object of the invention to provide a paper feeder having at least two sheet separators which provide reliable sheet separation of any kind of sheet ultimately which is usable in a sheet processing apparatus.

It is another object of the invention to provide a paper feeder of the type described and adapted for use in a facsimile transceiver which disables a second sheet separator and leaves a first sheet separator alone in operation where an original for transmission is inserted into a sheet carrier during use.

It is a further object of the invention to provide a paper feeder of the type described which is additionally provided with a third sheet separator.

Further objects of the invention will become apparent from the following description of an embodiment thereof with reference to the drawings.

DETAILED DESCRIPTION OF THE PREFERRED EMBODIMENT

Figure 1:
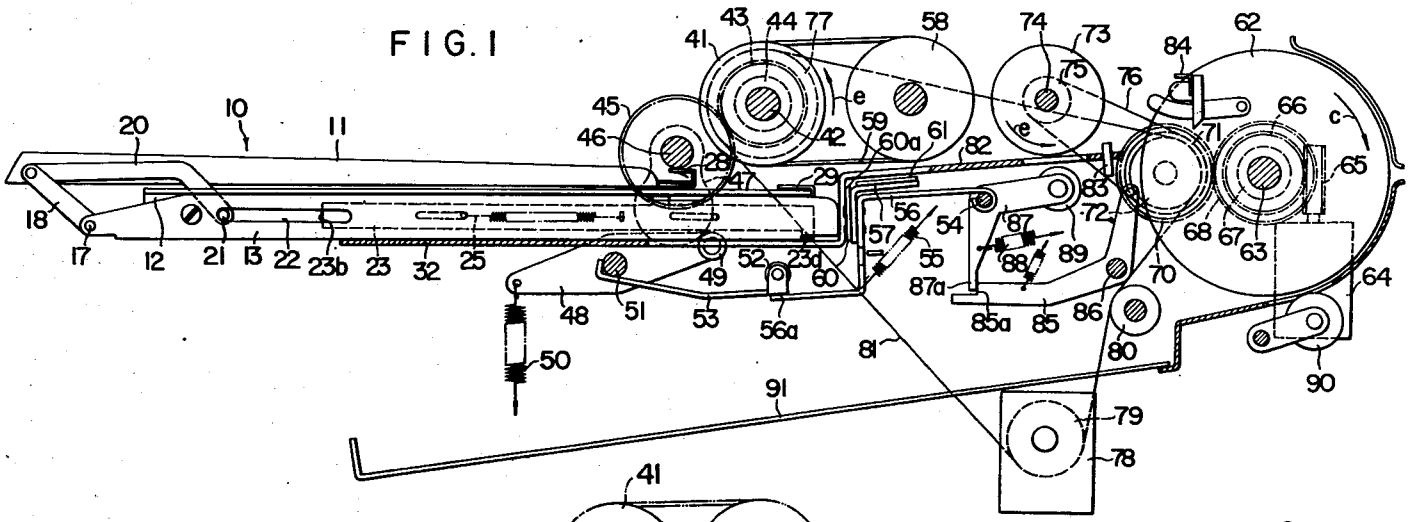
FIG. 1 is a side elevation of one embodiment of the invention as applied to a facsimile transceiver.
Figure 2:
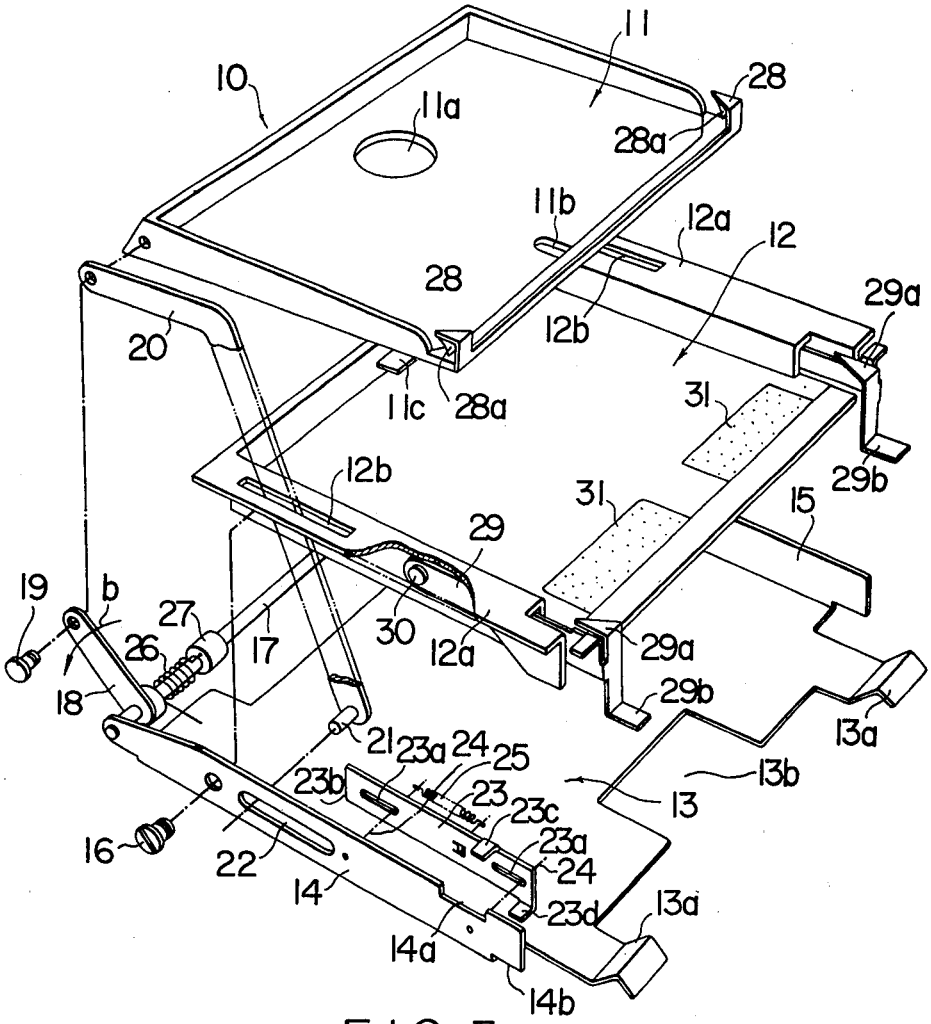
FIG. 2 is an exploded, perspective view of a sheet cassette having a pair of paper trays which is adapted for use in a facimile transceiver.

In the description to follow, the invention will be described as applied to a facsimile transceiver. Referring to FIGS. 1 and 2, there is shown a sheet cassette 10 which essentially comprises a first upper tray 11 on which a first sheet, for example, originals for transmission, are placed, a second lower tray 12 on which a second sheet or record sheet used during reception is placed, a cassette frame 13 which supports both trays 11, 12, and other members connecting these elements together. The second tray 12 is rockably supported on the cassette frame 13 by means of set screws 16 (only one being shown) which extend through openings formed in the sideplates 14, 15 on the opposite sides of the cassette frame 13 and engage the tray 12 toward its rear end. A stay 17 extends between and is rotatably supported by the rear ends of both sideplates 14, 15, and a pair of support arms 18 (only one being shown) for the first tray 11 are fixedly mounted on the stay 17 adjacent to its opposite ends. Screws 19 (only one being shown) pivotally mount the rear end of the first tray 11 on the free end of the support arms 18, whereby the first tray 11 is rockable with respect to the cassette frame 13 and the second tray 12. A pair of slide arms 20 have their rear end pivotally connected by means of set screws 19 with the rear end of the first tray 11 on its opposite sides, in the similar manner as the support arms 18. These slide arms 20 (only one being shown) extend through elongate slots **12*b* formed in flanges 12*a* which are formed along the opposite sides of the second tray 12. The other end of the slide arms 20 each has a pin 21 fixedly mounted thereon which extends through an elongate slot 22 (only one being shown) formed in each of the sideplates 14, 15 of the cassette frame to the outside thereof. A sliding plate 23 is located inside one sideplate 14 and is slidable longitudinally of the sideplate 14 by having a pair of spaced elongate slots 23*a* formed therein engaged with a pair of guide pins 24 which are fixedly mounted on the sideplate 14 and extend inwardly therefrom. A tension spring 25 extends between the sliding plate 23 and one guide pin 24, and the sliding plate 23 is normally urged to be displaced toward the rear end of the sideplate 14 under the resilience of the spring 25. Under this condition, the rear end 23*b* of the sliding plate 23 is aligned with an intermediate portion of the elongate slot 22. Adjacent to its other end or forward end, the sliding plate 23 is formed with a pair of upper and lower folded pieces 23*c*, 23*d*, which extend outwardly through notches 14*a*, 14*b* formed in the upper and lower edges of the sideplate 14.**

A coiled spring 26 is disposed on the stay 17, and has its one end secured to a collar 27 which is fixedly mounted on the stay and its other end held in resilient abutting relationship with the rear edge of the cassette frame 13. The resilience of the coiled spring 26 causes the support arm 18 to rotate in the direction of an arrow *b* shown in FIG. 2, together with the stay 17, whereby the first tray 11 is urged to move rearwardly above the second tray 12.

At its opposite corners, the front end of the first tray 11 is provided with a pair of corner separators 28 which are adapted to bear against the opposite corners of the front end of a first sheet which is placed thereon. In addition, the first tray 11 is formed with a sight opening **11*a* which permits a visual observation therethrough of the presence or absence of a second sheet or record sheet placed on the second tray 12 from a position above the first tray 11. The first tray 11 is also formed with a recess 11*b* in which the free end of a sensor lever, to be described later, is disposed for detecting the presence or absence of a first sheet. Finally, the first tray is also formed with a tongue 11*c* which causes the leading end of the first tray 11 to move along the flange 12*a* of the second tray 12.**

At its front end, the second tray 12 is provided with a pair of corner separators **29*a* on its opposite sides which are similar to the corner separators 28 in that they bear against the opposite corners of the front end of a second sheet placed thereon. Each of the corner separators 29*a* comprises an arm 29, the rear end of which is pivotally mounted on the sidewall of the second tray 12 as shown at 30, thereby allowing a rocking motion thereof. A pair of frictional members 31 such as rubber or cork sheets are fixedly mounted on the surface of the second tray 12** which receives the second sheet, adjacent to the forward edge thereof.

In its forward end, the cassette frame 13 is formed with a pair of chevron-shaped mounting arms **13*a* which may be utilized in fixedly mounting the frame in a paper feed station of an apparatus such as a facsimile transceiver to which the sheets are to be fed. The forward portion of the cassette frame 13 is also formed with a central notch 13*b* in which a lift lever 53** (see FIG. 1) is disposed as will be described later.

Figure 3:
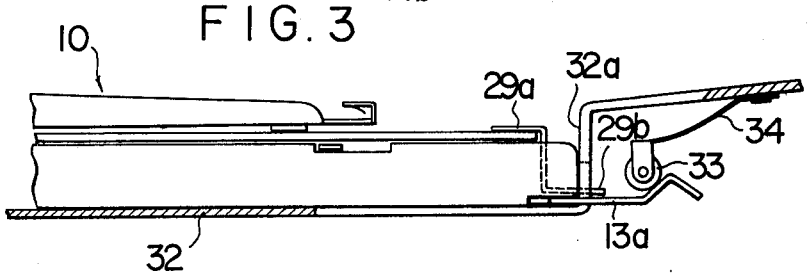
FIG. 3 is a side elevation, partly in section of the forward end of the sheet cassette of FIG. 2 as it is mounted on a cassette support plate.

As shown in FIG. 3, the cassette 10 thus constructed rests on a support plate 32 provided in the paper feeder station of a facsimile transceiver, for example, with the mounting arms **13*a* engaged by rollers 33 of a reduced diameter which are rotatably mounted on the free end of leaf springs 34 which are in turn fixedly attached to the underside of the support plate 32.**

Figure 4:
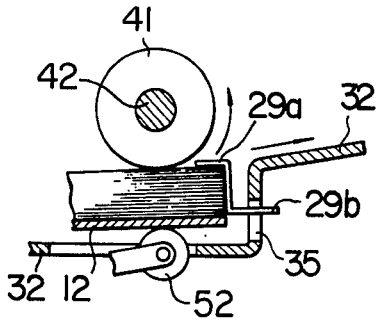
FIG. 4 is a fragmentary elevational cross section of one of the paper trays of FIG. 2 which is located in a paper feeding position, with the sheet on the tray being in contact with the feed roller.
Figure 5:
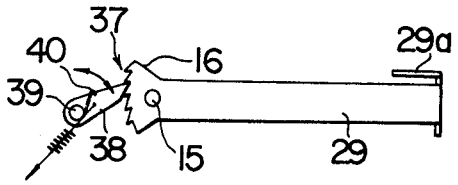
FIG. 5 is a side elevation of an exemplary corner separator which is mounted on one of the opposite sides of the paper tray of FIG. 4 at its front end.

The lower ends of the corner separators **29*a* are formed with projections 29*b* which extend into slots 35 formed in the vertical wall 32*a* of the support plate 32 when the cassette frame 13 rests thereon (see FIG. 4). The projections 29*b* are effective to prevent the corner separators 29*a* from being raised under the resilience of the leading end of the sheet when it is being fed by a feed roller 41. Instead of providing the projections 29*b* on the corner separators, the corner separators can be prevented from being raised under the resilience of the sheet, by providing the opposite end of the arm 29 which forms the corner separator with ratchet teeth 37, one of which is maintained in engagement with the tip end of a pawl 38, thus preventing a counterclockwise rotation of the arm 29, as viewed in FIG. 5. The pawl 38 is pivotally mounted at 39 on the sidewall of the second tray, and is biased into engagement with the ratchet teeth under the resilience of a spring 40. It is desirable to utilize springs of a relatively reduced strength to rotate the corner separators in a direction to bear against the sheet. On the other hand, the lower surfaces of the corner separators 28 on the first tray 11 may have a spring piece 28***a* of a reduced resilience fixedly mounted thereon for gently bearing against the opposite corners of the first sheet at its forward end.

As shown in FIG. 1, when the cassette frame 13 rests on the support plate 32, the cassette 10 is located such that the forward end of the second sheet which is placed on the second tray 12 is normally below the feed roller 41, while the first sheet which is placed on the first tray 11 may be moved to a position in which its forward end is located below the feed roller 41, by a forward movement, that is, by a movement to the right, as viewed in FIG. 1, over the second tray 12.

Figure 9:
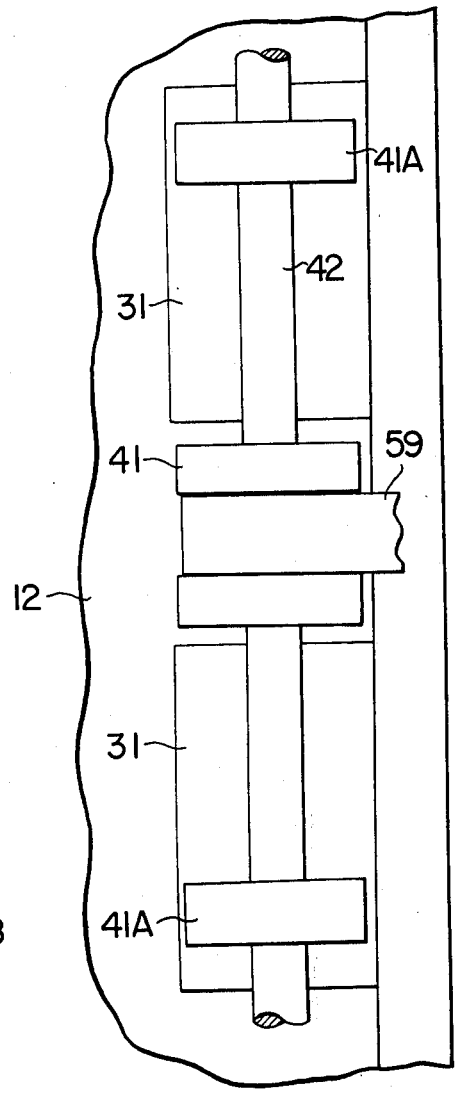
FIG. 9 is a plan view of a feed roller.

As shown in FIG. 9, the feed roller 41 is centrally mounted on a shaft 42, and on the opposite sides thereof are mounted a pair of auxiliary feed rollers 41A which are formed of a rubber having a reduced hardness as completed to that of the feed roller 41. Each of the frictional members 31 is located in opposing relationship with only the auxiliary rollers 41A, and do not extend to a position below the feed roller 41.

A gear 43 is mounted on the shaft 42 with a clutch 44 interposed therebetween, and meshes with another gear 45 which is mounted on a shaft 46 on which a cam 47 is secured. The cam is engaged by a roller 49 which is rotatably mounted on one end of an arm lever 48 and biased into abutment against the cam edge by a spring 50 which is connected with the other end of the lever 48. The arm lever 48 is mounted on a shaft 51 which is rotatably supported in the body of the facsimile transceiver. Secured to the shaft 51 is a lift lever 53 carrying rollers 52 which acts to raise the trays 11, 12 upward, as viewed in FIG. 1. The lower surface of the free end of the lift lever 53 is engaged by an extended end 56*a* of a crankarm 56 which is rockably supported by a stay 54 and which is biased by a spring 55 so as to cause the crankarm to oscillate in accordance with a rocking motion of the lift lever 53. Intermediate its length, the crankarm 56 has a shoulder to which is secured one limb of an L-shaped piece 57 (see FIG. 6). Fixedly mounted on the limb is a sheet separating plate 60 having a knife edge 60*a* formed along its upper edge, which is located opposite to a sheet conveying belt 59 which extends between the feed roller 41 and another roller 58. A second sheet separating member or frictional member 61 is fixedly mounted on the other limb of the piece 57 which extends at right angles to the first mentioned limb.

A drum 62 is fixedly mounted on a shaft 63 which is rotatably mounted in opposite sideplates (not shown) of the facsimile transceiver, and is adapted to rotate in a direction indicated by an arrow *c* by a drive from a drum drive motor 64 having an output shaft on which is secured a worm 65 which in turn meshes with a worm gear 66 which is coaxial and integral with the drum 62. A transmission gear 68 is mounted on the shaft 63 with a one way rotating clutch 67 of the conventional form such as a spring clutch interposed therebetween for synchronous rotation of the drum 62 with the rotation of the sheet conveying rollers, to be further described later.

Figure 7:
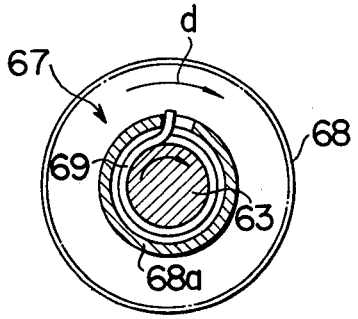
FIG. 7 is a cross section of one example of one-way rotating clutch which is provided on the shaft of a rotating drum of a facsimile transceiver.

As illustrated in FIG. 7, one way rotating clutch 67 comprises a coiled spring 69 which is wrapped around the shaft 63 and has one end locked with a boss 68*a* of the gear 68. As the transmission gear 68 rotates in the direction indicated by an arrow *d*, spring 69 firmly grips or engages the shaft 63, thus providing an integral connection between the transmission gear 68 and the drum shaft 63.

Figure 8:
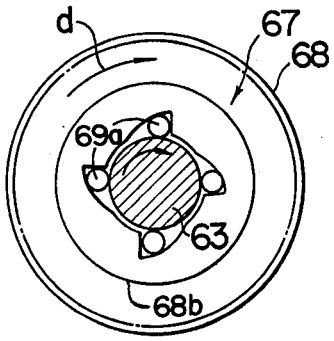
FIG. 8 is a cross section of another example of such a one-way rotating clutch.

FIG. 8 shows another form of one way rotating clutch which comprises balls 69*a* disposed between the shaft 63 and a boss 68*b* of the gear 68.

The transmission gear 68 meshes with a drum drive gear 70, and a pair of pulleys 71, 72 are concentrically mounted on a common shaft with the drive gear 70.

A belt 76 extends around the pulley 71 and another pulley 75 which is fixedly mounted on a shaft 74 on which a sheet conveying roller 73 is also mounted. Another belt 81 extends around the remaining pulley 72, a paper feed pulley 77 which is fixedly mounted on the same shaft as the feed roller 41, and output pulley 79 fixedly mounted on an output shaft of a paper feed drive motor 78 which represents the drive source for the sheet feeder, and an idler 80.

Figure 10:
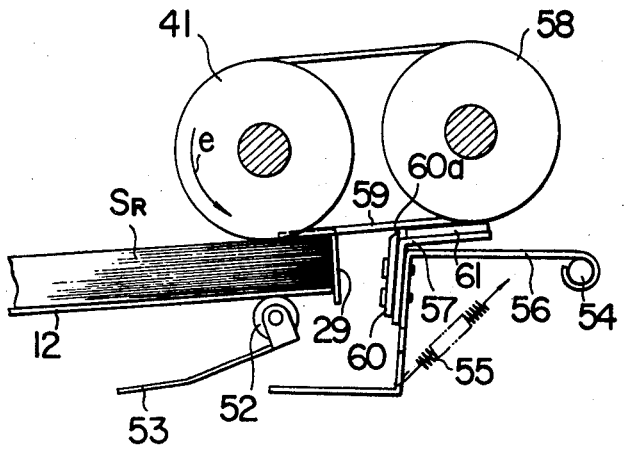
FIG. 10 is a fragmentary side elevation illustrating a sheet on the paper tray of FIG. 4 and a frictional member of the second separator of FIG. 6 which are in contact with the paper roller and a sheet conveying belt, respectively, at the instant of commencement of the paper feeding operation.

Turning firstly to the operation when a picture signal is transmitted to the facsimile transceiver described above from another facsimile system at a remote location, the paper feed drive motor 78 is set in operation, whereby the feed roller 41 and the sheet conveying roller 73 are rotated in a direction indicated by an arrow *e* through the various pulleys and the belts 76, 81. At the same time, the rotation of the drum drive gear 70 is transmitted to the transmission gear 68, thus rotating the drum 62 in the direction of the arrow *c* through the one way rotating clutch 67. On the other hand, the clutch 44 is also actuated, whereby the rotation of the paper feed pulley 77 is transmitted through the gear 43 to the gear 45, causing the cam 47 to rotate clockwise. As a consequence, the arm lever 48 oscillates under the resilience of the spring 50 to cause an oscillating movement of the lift lever 53 in the same direction, raising the second tray 12, which carries the second sheet, with the roller 52. At the same time the crankarm 56 follows the movement of the lift lever 53 to bring the knife edge 60*a* of the sheet separating plate 60 and the frictional member 61 into contact with the sheet conveying belt 59 (see FIG. 10). As the tray 12 is raised, the second sheet thereon is fed out of this tray by contact with the feed roller 41 which rotates in the direction of the arrow *e*. When the uppermost second sheet is separated from the remaining sheets in the stack SR by the action of the corner separators 29, sheet separating plate 60 and frictional member 61, and is fed along a sheet guide plate 82, it comes to a temporary stop at a position below the sheet conveying roller 73 by abutment against a stop 83 which projects upwardly from the guide plate 82. By this time, the cam 47 has rotated to its initial position, deactuating the clutch 44. Also the lift lever 53 and the crankarm 56 have returned to their initial position shown in FIG. 1, thus removing the contact between the second sheet and the feed roller 41.

Figure 11:
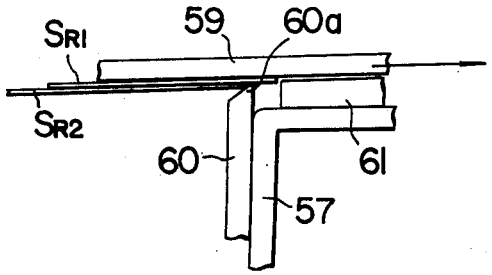
FIG. 11 is an enlarged side elevation of a sheet as it is separated by the third separator of FIG. 6.
Figure 12:
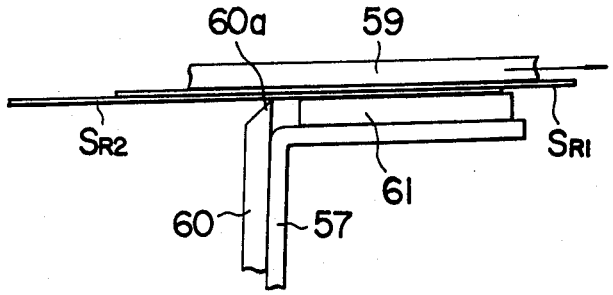
FIG. 12 is an enlarged side elevation of a sheet as it is separated by the second separator of FIG. 6.
Figure 15:
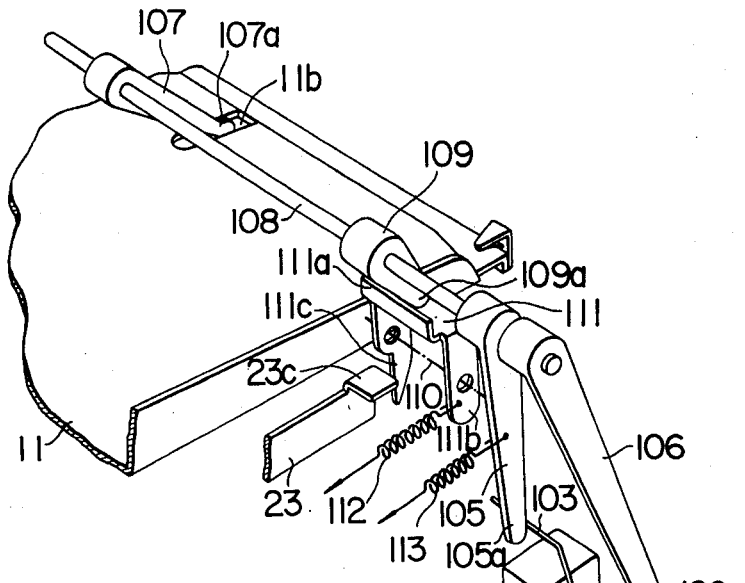
FIG. 15 is a perspective view of a transmit-receive mode changing mechanism of a facsimile transceiver.

The uppermost second sheet SR1 which is fed from the second tray 12 by the feed roller 41 is initially separated by the action of the corner separators 29*a*. In the event of a failure of paper separation by the first separator or corner separators resulting in a pair of sheets being fed simultaneously, the sheet SR1 is separated from the sheet SR2 by the knife edge 60*a* of the sheet separating plate 60 which is located at a downstream position. Specifically, as illustrated in FIG. 11, the uppermost sheet SR1 moves over the knife edge 60*a* of the separating plate by virtue of the frictional engagement with the sheet conveying belt 59 as it runs, and continues to be conveyed in the downstream direction while a movement of the lower sheet SR2 is blocked by the knife edge 60*a*, thus separating the two sheets from each other. Any plurality of sheets which remain attached to each other to be conveyed in the downstream direction by frictional engagement of the upper sheet SR1 with the sheet conveying belt 59 as shown in FIG. 12 will reach a position in which the lower sheet SR2 comes into frictional engagement with the frictional member 61, which serves to stop the lower sheet at this position. An arrangement is made such that the frictional force acting between the sheet SR1 and the conveying belt 59 as well as between the sheet SR2 and the frictional member 61 is greater than the frictional force acting between the sheets SR1 and SR2.

Thus, the plurality of sheet separation means acting on sheets attaching to another in different manners and sequentially, minimize the failure of sheet separation by their synergetic sheet separating effect. Since the knife edge 60*a* is disposed in opposing relationship with the flexible conveying belt 59, any variation in the thickness of a sheet being conveyed may be accommodated for by the flexibility of the conveying belt 59.

The lower surface of the belt 59 may gently contact the knife edge 60*a*. Alternatively, a clearance corresponding to the thickness of a single sheet may be maintained therebetween. The pressure of contact or clearance between the knife edge 60*a* and belt can be adjusted by vertically moving the separating plate 60 relative to the crankarm 56.

As the drum 62 rotates, a sheet retaining pawl 84 which is disposed on the peripheral surface of the drum and extending along the direction of the rotational axis thereof is opened by a sheet setting cam (not shown) which cooperates with the rotation of the drum. When the retaining pawl 84 reaches a given position in which it is prepared to hold the leading end of the second sheet during the rotation of the drum, a lever 85 which is pivotally mounted on a pin 86 and having an arm extending to the proximity of the periphery of the drum 62 rocks counterclockwise whereupon a follower 89 which is disposed in opposing relationship with the sheet conveying roller 73 moves into abutment thereagainst, thus holding the leading end of the second sheet. At the same time, the stop 83 is retracted from the sheet passageway, whereby the second sheet again begins to be fed to permit the leading end thereof to the rapidly advanced into a position below the retaining pawl 84. Immediately thereafter, an operating member (not shown) associated with the retaining pawl 84 is disengaged from the sheet setting cam to allow the pawl 84 to be closed, thus securing the leading end of the second sheet to the drum 62. It is to be noted that during this process, the drum 62 and the sheet conveying roller 73 are synchronously rotated through the drum drive gear 70 and the transmission gear 68 in a manner such that the travelling speed of the second sheet being fed and the speed of movement of the retaining pawl 84 satisfy the above mentioned timing. With its leading end secured to the drum 62, the second sheet is wrapped around the drum surface as the latter rotates. When the second sheet is completely wrapped around the drum 62, the drum drive motor 64 is energized, and thereafter only the drum drive motor 64 is effective to rotate the drum 62 with a speed which exceeds the rotational speed of the gear 68. At this time, the rotating movement of the gear 68 is prevented from influencing upon the drum through the action of the one way rotating clutch 67.

During the subsequent rotation of the drum 62 which is driven by the motor 64, a picture signal from a remotely located facsimile system is applied through a recording stylus (not shown), which is adapted to move along the direction of the rotational axis thereof, thereby recording an image on the second sheet in accordance with the known technique. Upon completion of such a recording operation, the retaining pawl 84 is released again, and simultaneously a delivery roller 90 bears against the peripheral surface of the drum 62 to deliver the recorded sheet onto a delivery tray 91.

Figure 13:
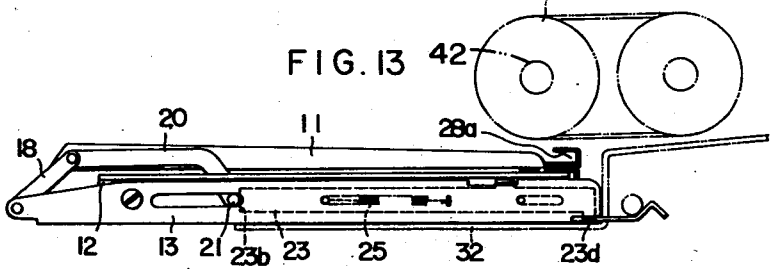
FIG. 13 is a side elevation of a two deck cassette in FIG. 1 when the upper paper tray is in its paper feeding position.

Turning now to the operation when transmitting an original as a first sheet, the sheet is placed on the first tray 11 and the first tray moved forwardly or to the right, as viewed in FIG. 1, to a position in which the leading end of the first sheet is located below the feed roller 41 as shown in FIG. 13. Under this condition, the paper feeder motor 78 is set in operation to initiate a feeding operation generally in the similar manner as mentioned above in connection with the second sheet, thus transmitting the original.

Figure 14:
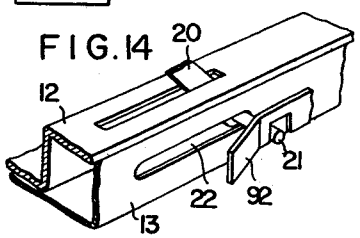
FIG. 14 is a perspective view of means for locking the upper paper tray in its feeding position.

When moving the first tray 11 to the right as viewed in FIG. 1, at a level above the second tray 12, the pin 21 moves along the elongate slot 22 until it engages a detent member 92, as shown in FIG. 14, which is disposed on the body of the facsimile transceiver, thus fixing the tray 11 in the paper feeding position.

The cassette 10 shown in constructed to operate a mode switching assembly which switches between a plurality of transmit modes of the facsimile transceiver as the first tray 11 slides to a position in which the leading end of the first sheet is located below the feed roller 41. Specifically, referrring to FIGS. 15 to 18, there is shown an operating piece 100 which is associated with a switch assembly 102. The operating piece 100 is biased for rotation in the counteclockwise direction but may be rotated in the clockwise direction against such bias to open or close switch contacts 101. A pair of actuators 103, 104 are fixedly attached to the operating piece 100, and a pair of arms 105, 106 have their free ends 105*a*, 106*a* located in opposing relationship with the respective extended ends of the actuators 103, 104. The arrangement is such that when one of the arms 105, 106 moves the associated actuator against the bias applied to the operating piece, the other arm and its associated actuator move in the direction away from each other. A sensor lever 107 is disposed on the path of movement of the first tray 11 and is rocked in response to the presence or absence of the first sheet or transmit original $S_O$ for cooperation with the arms 105, 106.

More specifically, the sensor lever 107 and the arms 105, 106 are mounted on a rotatable shaft 108, which has a trigger lever 109 also fixedly mounted thereon. A two-arm member 111 which is pivotally mounted on a shaft 110 which extends parallel to the shaft 108 has its folded tab 111*a* located in the path of rotation of the trigger lever 109. One arm 111*b* of the member 111 is connected with a compression spring 112, which urges the member 111 to rotate clockwise about the shaft 110, as viewed in FIGS. 16 to 18. The arms 105, 106, sensor lever 107 and trigger lever 109 are urged to rotate clockwise, as viewed in these Figures, about the axis of the shaft 108 by a compression spring 113 which is connected with the arm 105. However, the resulting rotation of the arms 105, 106 under such bias is normally prevented by abutment of an extended end 109*a* of the trigger lever 109 against the folded tab 111*a* of the member 111. The resilience of the respective springs is chosen such that the rotative effort applied to the arms 105, 106 and trigger arm 109 is stronger than that applied to the actuators 103, 104 and is less than that applied to the two-arm member 111. The lever ratio of the sensor lever 107, trigger lever 109 and two-arm member 111 is chosen such that the sensor lever 107 immediately retracts upardly from the recess **11*b* in the first tray upon retraction of the sliding plate 23 when the first tray 11 is displaced rearwardly from the paper feeding position (the position shown in FIG. 3**) through any slight amount.

Figure 16:
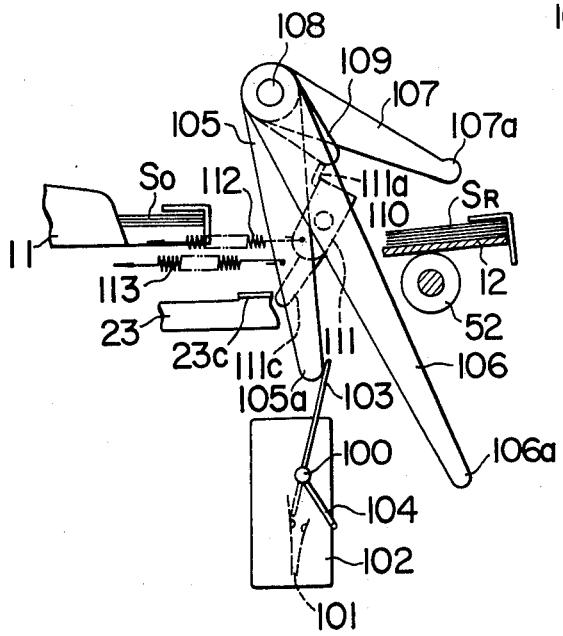
FIG. 16 is a side elevation of the mode changing mechanism of FIG. 15 when the transceiver is in its receive mode.

The mode switching assembly has a first mode which is a receive mode illustrated in FIG. 16 in which the trigger lever 109 is urged counterclockwise by the two-arm member 111, whereby the sensor lever 107 is retracted from the paper feeding position of the respective trays 11, 12 and the second tray 12 assumes its paper feeding position (the position shown in FIG. 1).

Figure 17:
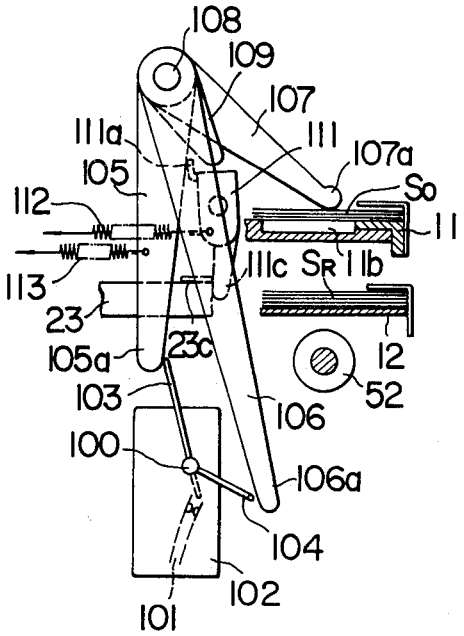
FIG. 17 is a side elevation of the mode changing mechanism when the transceiver is in its multi-transmit mode.
Figure 18:
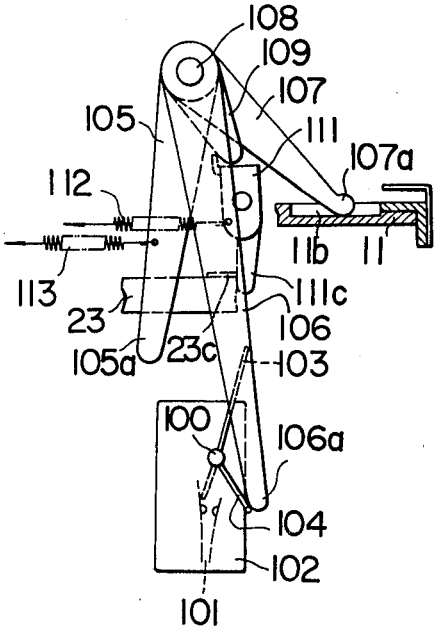
FIG. 18 is a side elevation of the mode changing mechanism when the originals for transmission on the upper paper tray are exhausted.

The mode switch assembly has a second mode which is a multi-transmit mode illustrated in FIG. 17 in which the first sheet $S_O$ is placed on the first tray 11 and the latter located in its paper feeding position. Specifically, when the first tray 11 is moved from the position shown in FIG. 16 to the position shown in FIG. 17, the pin 21 causes the sliding plate 23 to move forwardly. Thereupon the folded tab **23*c* of the sliding plate 23 urges the two-arm member 111 against the bias applied thereto in a maner such that the trigger lever 109 rotates clockwise about the axis of shaft 108 under the resilience of the spring 113 and the sensor lever 107 and the arm 105 rotate in the same direction, thus switching the switch contacts 101 from their OFF to ON position to change the facsimile system into a multi-transmit mode. Thereupon, the facsimile is prepared to transmit the transmit original $S_O$. When the transmit original $S_O$ includes a plurality of sheets, rotation of the sensor lever 107 which would otherwise occur upon termination of the transmission of the single sheet as the scanning head turns on an end switch is prevented by the next sheet of the transmit original, whereby the switch contacts 101 remain in their ON position, permitting the plurality of sheets in the transmit original $S_O$ to be transmitted consecutively. When the last sheet of the transmit original on the first tray 11 is transmitted, the extended end 107*a* of the sensor lever 107 falls into the recess 11b in the tray 11, whereby the switch contacts 101 are changed from their ON position to their OFF position, so that the facsimile system changes to its transmit mode illustrated in FIG. 18 as the scanning head has turned the end switch on. This mode represents an intermediate mode of operation between the two modes mentioned above in that in this mode, if a plurality of sheets are placed on the tray 11 as the transmit original, the sensor lever 107 is rotated counterclockwise against the bias applied thereto to change the facsimile system into the multitransmit mode illustrated in FIG. 17 by the similar process as mentioned above. When it receives a receive command from a remotely located facsimile system during the time it is in its transmit mode, an ejector (not shown) which is operated in response to the command causes the detent member 92 to be disengaged from the pin 21 to return the first tray 11 to its initial position under the resilience of the spring 25**, thus automatically switching to the receive mode.

Figure 19:
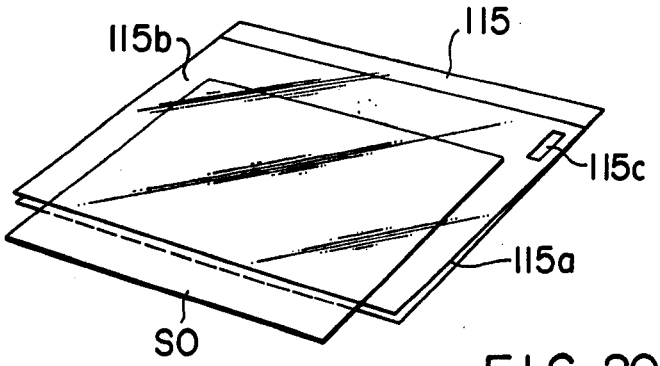
FIG. 19 is a perspective view of a sheet inserted into a sheet carrier formed of a transparent sheet member.
Figure 20:
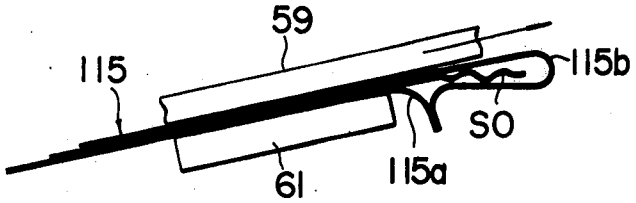
FIG. 20 is an enlarged side elevation of a sheet carrier as it is being fed by the second separator.

The cassette 10 is also constructed in a manner such that the separating plate 60 and the frictional member 61 may be moved toward or away from the sheet conveying belt 59 in response to a movement of the first tray 11 in the forward or reverse direction. Since the size, configuration, thickness and elasticity of the first sheet varies from sheet to sheet because of its nature as a transmit original, it is usually inserted inside a sheet carrier 115 in the form of a folded sheet of a transparent film-like material, as illustrated in FIG. 19, before it is placed on the first tray 11. When the transmit original $S_O$ as inserted inside such sheet carrier is subjected to the sheet separating action of the separating plate 60 and the frictional member 61, the folded construction of the sheet carrier results in the similar effect as a plurality of transmit originals are being fed simultaneously to cause a jamming of the sheet carrier in the conveying path as illustrated in FIG. 20. This is because the lower sheet portion **115*a* of the carrier is blocked by the frictional force applied from the frictional member 61 while the upper sheet portion 115*b* alone continues to be conveyed in the downstream direction by the sheet conveying belt 59**. Thus, proper feeding of the transmit original is prevented.

Figure 6:
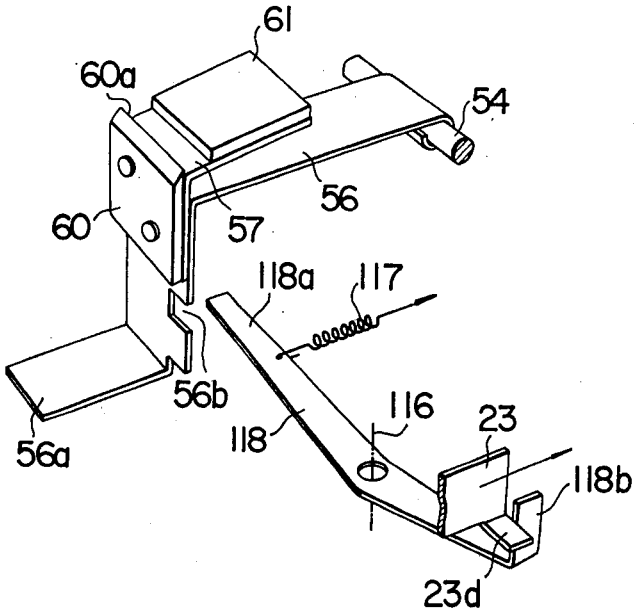
FIG. 6 is a perspective view of parts of second and third separators as well as a mechanism which disables them.

Such difficulty is avoided by the arrangement shown in FIG. 6. Specifically, the crankarm 56 is formed with a notch **56*b* in its one side, and a lever 118 is pivotally mounted at 116 and located such that one end 118a thereof is disposed adjacent to the notch 56*b* on the side nearer the drum while the other end 118*b* on the side nearer the drum while the other end 118*b* is disposed adjacent the folded tab 23*d* on the sliding plate 23 on the side nearer the drum. In addition, a spring 117 is connected with the lever 118 so as to cause it to rotate in a direction such that said one end 118*a* moves away from the notch. With this arrangement, when a transmit original $S_O$ inserted inside a sheet carrier 115 is placed on the first tray 11 and the latter moved to the right, as viewed in FIG. 1, to its paper feeding position, the pin 21 moves along the slot 22 in the same direction as the first tray 11, pushing the rear end 23*b* of the sliding plate 23. This causes the sliding plate 23 to move toward the forward end of the cassette 10 against the resilience of the spring 25 (see FIG. 13), with the folded tabs 23*d* abutting against the end 118*b* of the lever 118 to cause it to rotate about the pivot 116 against the resilience of the spring 117 until the end 118*a* extends into the notch 56*b* formed in the crankarm 56. When the lift lever 53 rotates under this condition, the transmit original is raised, with the uppermost sheet moving into contact with the feed roller 41. Thereupon, it is separated by the corner separators 29 which bears against the opposite corners of the front end thereof and then conveyed by the belt 59 to reach the downstream sheet separation station which comprises the frictional member 61. However, the engagement between the notch 56*b* and the end 118*a* of the lever 118 prevents the crankarm 56 from following the movement of the lift lever 53, thus maintaining the frictional member 61 away from the sheet conveying belt 59. Consequently, the sheet carrier 115 is conveyed to a position below the conveying roller 73 without being subjected to a separating action by the frictional member 61. Subsequently, a similar operation takes place as mentioned above to wrap it rapidly around the drum 62, and a scanner (not shown) which is adapted to move along the direction of the rotational axis of the drum 62 scans the image on the transmit original for transmission to a remotely located facsimile system, and finally the carrier is delivered by the delivery roller 90 onto the delivery tray 91**.

When a single deck cassette is employed in the facsimile system and utilized to move the frictional member 61 toward or away from the belt 59, the sheet separating function by the frictional member 61 may be selectively disabled by disposing a member corresponding to the sliding plate 23 on the side of the cassette support plate 32, for example, and operating such member in different manners depending on whether a sheet carrier is used, irrespective of the kind of the original. Alternatively, a cassette 210 may be prepared which is adapted for use with sheets which utilize a sheet carrier.

Figure 21:
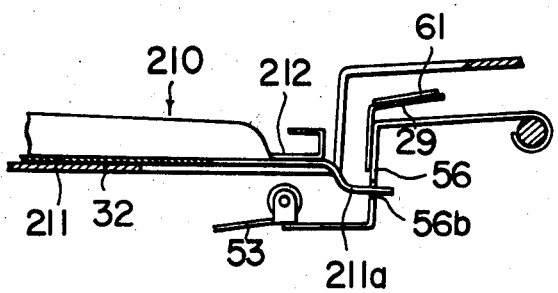
FIG. 21 is a side elevation of another form of means for disabling the second separator.

Specifically, referring to FIG. 21, the cassette 210 includes a base plate 211, the forward end of which is formed with a tongue 211*a* which is located so that it enters the notch 56*b* in the crankarm 56 to which the frictional member 61 is secured when the cassette 210 is set in position on the cassette support plate 32. A sheet receptacle 212 which is channel-shaped in cross section is rockably supported by the base plate 211, and the arrangement is such that when the receptacle 212 is pushed up by the lift lever 53, the crankarm 56 cannot move in following relationship therewith, being held by base plate 211 thus disabling the frictional member 61.

Where a cassette is not utilized in loading sheets, the sheet carrier 115 may be formed with an opening 115*c* or applied with a sensor mark outside sheet receiving area, and such opening or sensor mark may be detected by suitable means such as a microswitch or photosensor to produce a signal to an electromagnetic plunger, for example, for retracting the frictional member 61 from the sheet passageway. In this instance, the frictional member can be automatically disabled when a stack comprising a combination of usual sheets and sheet carriers is employed.

What is claimed is:

1. A sheet feeder comprising:

a first tray means for receiving a transmit original which is inserted inside a sheet carrier formed by a transparent sheet material;

a second tray means for receiving a plurality of recording sheets in a stack;

means for selectively locating one of the first and second tray means in a paper feeding position;

sheet feed means for feeding sheets including:

a corner separator; and a feed roller means for respectively feeding a transmit original and recording sheet from the first and second tray means when respectively located in the paper feeding position;

an endless sheet conveying belt disposed above a passageway followed by a transmit original inserted in a sheet carrier and a recording sheet as they are respectively fed by the sheet feed means, the conveying belt being disposed for contact with the upper surface of a respective passing sheet carrier and recording sheet for conveying it to a processing station;

a frictional member disposed below the passageway and having a frictional surface gently pressed against the surface of the sheet conveying belt;

means for supporting the frictional member in a movable manner for movement in a direction normal to the surface of the sheet conveying belt; and means for maintaining said frictional member and its frictional surface away from the sheet conveying belt when the first tray means is located in the paper feeding position.

2. A sheet feeder according to claim 1 further comprising a conveying roller located nearer the sheet processing station than said feed roller means and downstream of said endless sheet conveying belt.

3. A sheet feeder according to claim 1, further comprising means for sheet separating disposed intermediate the sheet feed means and the frictional member.

4. A sheet feeder according to claim 3 in which the means for sheet separating is formed with a knife edge along its upper edge, the knife edge being disposed in the region of the sheet passageway in a position within the range from gentle abutting relationship with the endless conveying belt to being spaced therefrom by a clearance corresponding to the thickness of a single sheet.

5. A sheet feeder according to claim 3 in which the means for sheet separating is mounted for movement with said frictional member.

6. A sheet feeder according to claim 1 further comprising mode switching means for switching between a transmit mode and a receive mode in response to the respective locating of the first and second tray means in the paper feeding position.

7. A sheet feeder according to claim 1 further comprising mode switching means for switching to a multi-transmit mode in response to the locating of the first tray means in the paper feeding position.

8. A sheet feeder according to claim 7 wherein said switching means comprises sensor means for sensing the presence of sheets on said first tray means.

9. A sheet feeder according to claim 1 wherein said maintaining means comprises means movable with said first tray means for holding said supporting means against movement.

10. A sheet feeder according to claim 1 wherein said sheet feed means further comprises a second corner separator and the two corner separators are respectively mounted on said first and second tray means.

* * * * *